US005544027A

United States Patent [19]

Orsano

[11] Patent Number: 5,544,027

[45] Date of Patent: Aug. 6, 1996

[54] LED DISPLAY FOR PROTECTIVE HELMET AND HELMET CONTAINING SAME

[76] Inventor: Anthony Orsano, 529 Marcellus Rd., Williston Park, N.Y. 11596

[21] Appl. No.: 38,156

[22] Filed: Mar. 26, 1993

[51] Int. Cl.[6] ..... F21L 15/14

[52] U.S. Cl. ..... 362/105; 362/800; 2/422

[58] Field of Search ..... 2/422, 410, 209.1, 2/209.13, 425; 362/105, 106, 103, 72, 249, 800; 36/137

[56] References Cited

U.S. PATENT DOCUMENTS

| | | | |
|---|---|---|---|
| 4,231,079 | 10/1980 | Heminover | 362/106 |
| 4,761,720 | 8/1988 | Solow | 362/249 X |
| 4,891,736 | 1/1990 | Gouda | 362/72 X |
| 4,999,747 | 3/1991 | Chen | 362/105 X |
| 5,033,212 | 7/1991 | Evanyk | 362/103 X |
| 5,054,124 | 10/1991 | Darvas | 2/174 X |
| 5,128,843 | 7/1992 | Guritz | 362/103 |
| 5,188,447 | 2/1993 | Chiang et al. | 362/103 |

*Primary Examiner*—Peter Nerbun
*Attorney, Agent, or Firm*—Lieberman & Nowak, LLP

[57] ABSTRACT

A light emitting diode display can be added to conventional protective helmets or incorporated in newly-manufactured helmets. LEDs increase wearer visibility during evening hours and provide decoration which appeals to the wearer and encourages use of the helmet. The LEDs are coupled to an internal power source, such as a battery in the helmet, or an external power source, such as a bicycle mounted generator, via an electric cord. The LEDs can be lit simultaneously or sequentially, the sequence being regulated by a computer chip. The timing and rate of sequence can be varied, thus making the helmet consistently interesting to the wearer and children in particular.

8 Claims, 4 Drawing Sheets

LED DISPLAY FOR PROTECTIVE HELMET AND HELMET CONTAINING SAME

BACKGROUND OF THE INVENTION

The invention relates to light emitting diode (LED) displays for use with protective helmets, and to helmets containing such displays.

It is estimated that over 75% of bicycle accident fatalities occur from head injuries. Moreover, several states, including New York and New Jersey, have recently passed legislation mandating the use of protective helmets for children on bicycles. Accordingly, there is a great need for protective helmets which appeal to children and encourage their use. Additionally, manufacturers are constantly developing new ways to make bicyclists, rollerskaters and skateboarders more visible during twilight and evening hours. This invention accomplishes both goals by providing a helmet which is both decorative and visible at night.

It is therefore an object of this invention to provide a LED display which can be attached to conventional protective helmets.

Another object of the invention is to provide a helmet having an LED display which is aesthetically appealing.

A further object of the invention is to provide a helmet which is visible under low light conditions.

Lastly, it is an object of this invention to provide a safety device which encourages wearing of a helmet during risky activities.

SUMMARY OF THE INVENTION

The invention provides a light emitting diode display for use with a protective helmet. This comprises a plurality of light emitting diodes, means for supplying electricity to the diodes, and means for affixing the diodes to the helmet.

Means for providing electricity to the diodes generally comprise a plurality of conductors electrically coupled to the diodes that in turn are coupled to a power source, such as a battery or generator. A generator, if employed, is normally located outside of the helmet and is coupled to the helmet by a detachable electric cord. In such a case the means for supplying electricity to the diodes comprise a connector for releasably engaging an electric cord.

Means for affixing the diodes to the helmet normally comprise an adhesive, with the diodes being affixed to the helmet and being visible through holes in the helmet. The diodes may also be mounted on a conduit having a top and a bottom. This conduit is oftentimes coated with an adhesive on the bottom, the light emitting diodes being on the top. The adhesive in turn is often covered by a release layer which can be removed to expose the adhesive for contacting the adhesive with the helmet.

Means for regulating the lighting of the diodes are generally provided and typically comprise a computer chip.

The invention also provides a protective helmet having a shell formed of an impact resistant material, a plurality of light emitting diodes secured to the shell, and means for supplying electricity to the diodes.

The diodes are usually mounted within holes traversing the shell. The protective helmet often further comprises a power source electrically coupled to the means for supplying electricity to the diodes, such as a battery. Means are usually present for regulating the lighting of the diodes. These means usually comprise a computer chip.

DETAILED DESCRIPTION OF THE INVENTION

The preferred embodiments of the invention will now be described in detail. These embodiments are to be considered illustrative of the subject invention, but are not to be construed as limiting.

The invention relates generally to LED displays for use with protective helmets and helmets containing such displays. The invention will now be described with reference to the attached figures. Numbers used throughout this application are consistent from figure to figure.

Figure 1:
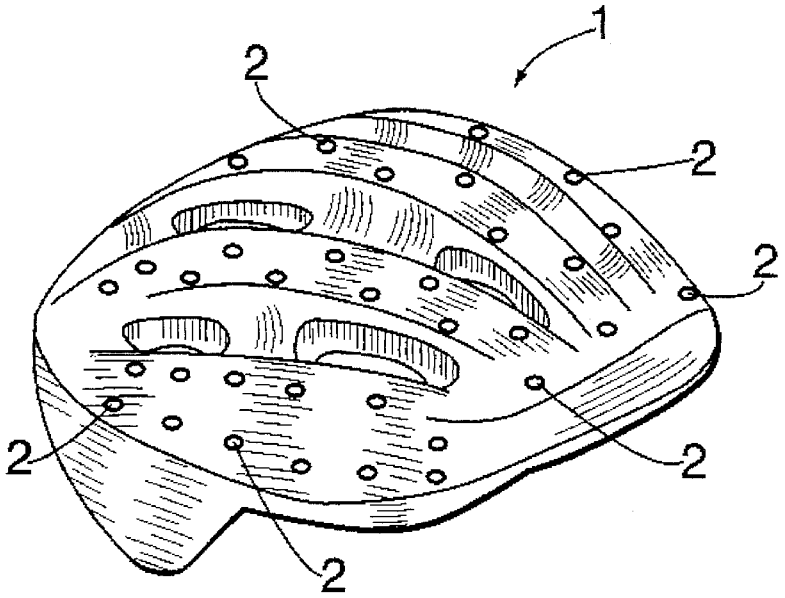
FIG. 1 shows a prospective view of the subject helmet.

FIG. 1 shows a prospective view of helmet 1 containing a plurality of LEDs 2 which protrude through openings in the helmet shell. LEDs 2 are visible from the exterior of helmet 1 and provide both decoration and a beacon to warn others of the wearer's presence. Although LEDs are shown extending above the surface of helmet 1, they could also be recessed or flush mounted to minimize the chance of breaking if helmet is dropped or thrown.

Figures 5, 5A:
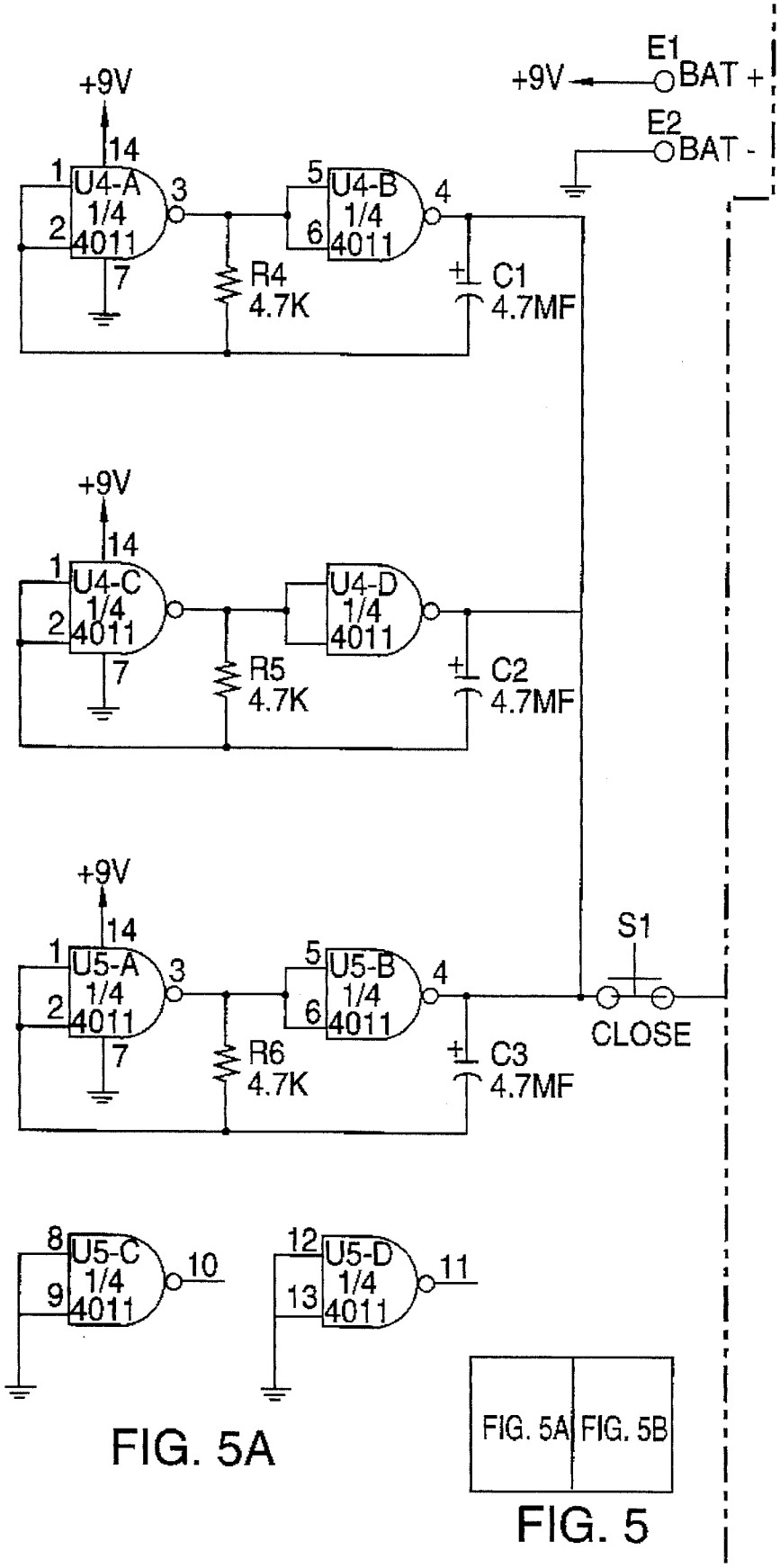
FIGS. 5, 5A, and 5B show a schematic for an LED display or helmet containing such a display.
Figure 5B:
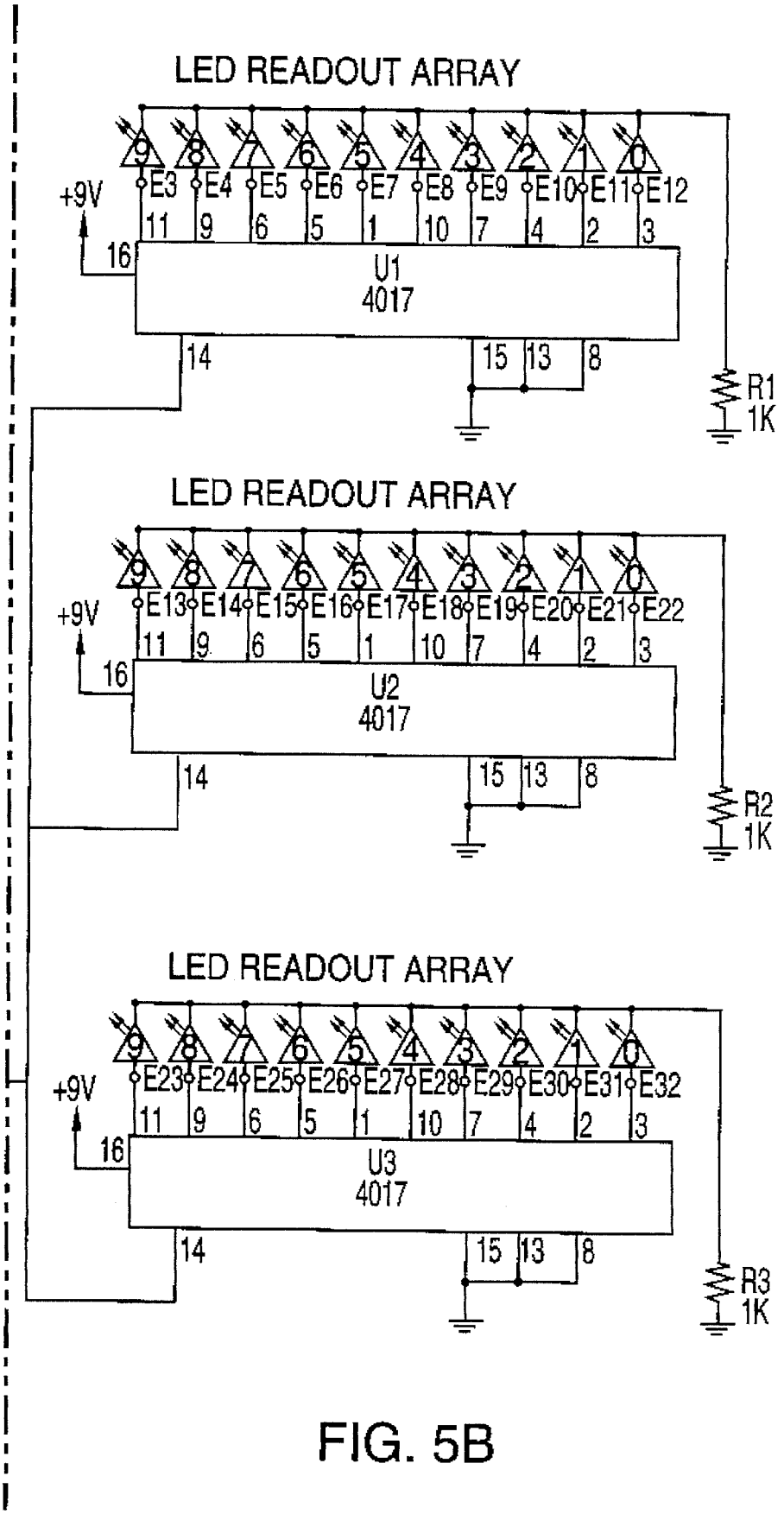

LEDs 2 may be powered by any power source 3, however, such a power source will typically comprise a nine-volt (9 V) battery 3A. LEDs 2 may be wired directly to the power source 3 (i.e., a constantly on or off display), or preferably, by power source 3 coupled with circuitry that permits sequential lighting of LEDs 2. This circuitry (shown in FIG. 5) may be incorporated onto a single computer chip. The chips shown in FIG. 5, i.e., the 4017 and 4011 chips, are commercially available from numerous sources. The circuit shown in FIG. 5 provides three lines of ten LEDs 2 per line which light sequentially, i.e. the first LED of each line is lit, followed by the second, third, etc.

LEDs 2 are available in numerous colors, therefore, it is to be considered within the scope of the invention to employ multiple colors and color combinations. Likewise, LEDs 2 may be arranged in any configuration. Thus, the pattern of LEDs 2 may vary from random, to loosely orientated, to precisely geometric. The colors, LED patterns and ornamentation selected should be those likely to appeal to the wearer. Thus, incorporating the images of youth idols, cartoon characters and the like to augment the LED display is encouraged.

The timing of LED 2 lighting may be controlled. Thus, the lights may be sequentially lit, as for example, from front to back as illustrated by arrow A in FIG. 2A (and described above with reference to FIG. 5), from side to side, from back to front, or any other conceivable lighting pattern. The rate of lighting may also be varied. For example, a switch may be provided to permit variations in the lighting rate or lighting pattern. Such switches are well known in the art and are not described further in detail. Moreover, it is well known from the field of LED signage (such as displays used in advertising) to control the lighting of LEDs to form word, design stream of words or the like. Such a use of LEDs may be incorporated into the subject helmets and displays.

Figure 4:
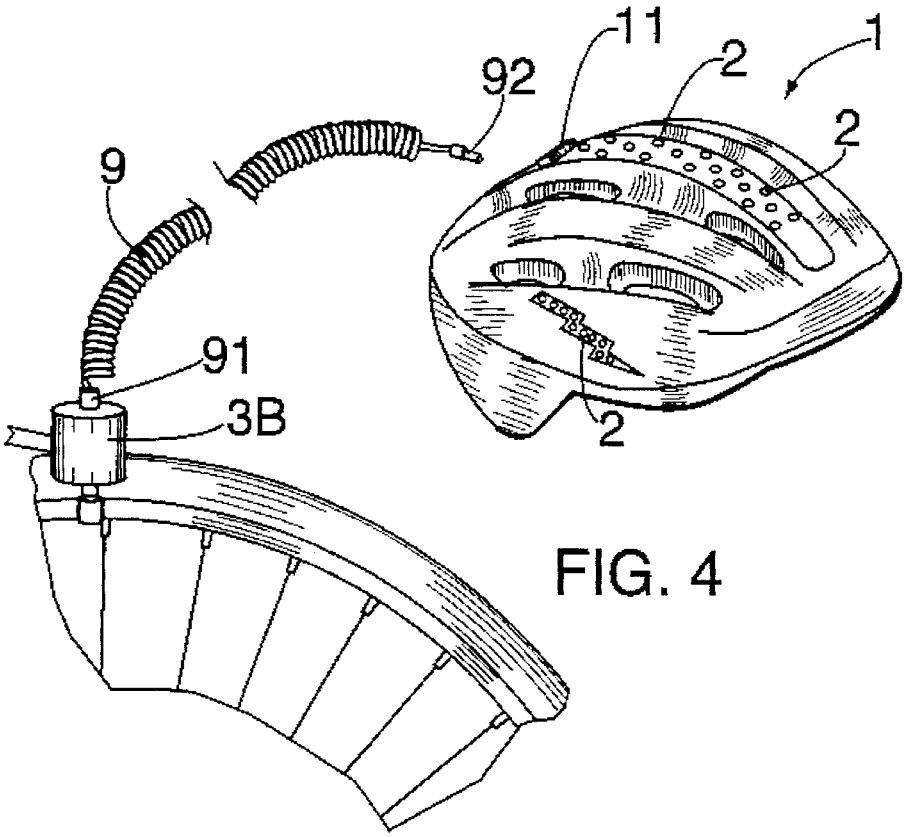
FIG. 4 shows a view of the subject helmet adapted to be run by a generator.

The source of power 3 as stated above, is typically nine-volt battery 3A. However, LEDs 2 may also be powered by a generator 3B driven by any number of sources, including the movement of a bicycle's tire (as shown in FIG. 4). Such generators 3B are well known and may be linked to the helmet via an electrical connection, such as an electric cord 9. For safety reasons, the electrical connection between LEDs 2 and generator 3B is typically made of a resilient expandable wire (similar to a telephone cord) having one end 91 which plugs into the generator and a second end 92 which plugs into helmet 1. Both ends 91 and 92 should be readily disconnectable so that if the wearer is knocked from the bicycle, the cord would readily detach to minimize any chance of injury.

Figure 2A:
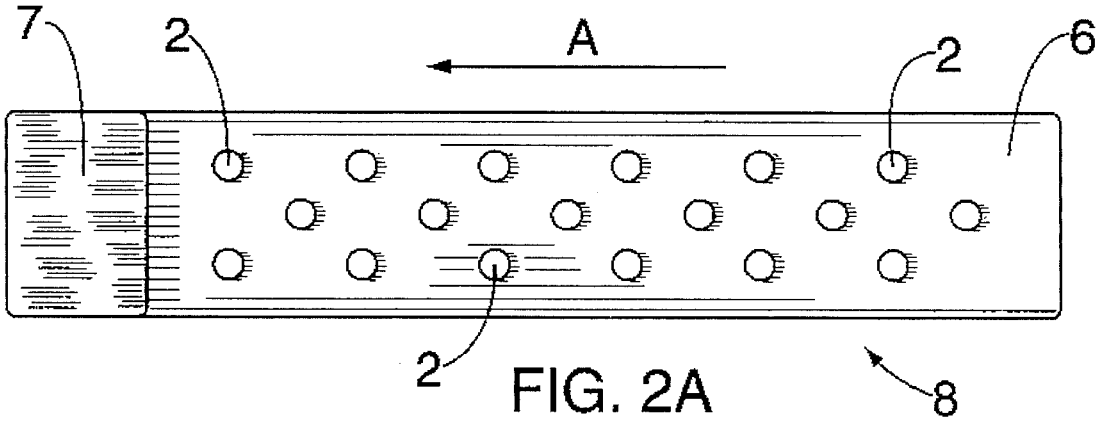
FIG. 2A shows a top view of a LED display used on a conventional protective helmet.

FIG. 2A depicts an embodiment wherein LEDs 2 of the display are contained on a strip (the entire LED display strip for use on pre-existing helmets is identified as 8) which can be affixed to a conventional helmet 1. One method of affixation is by providing adhesive layer 4 on the side of display strip 8 opposite LEDs 2. Other means such as a multiplicity of interconnecting hooks and filaments (such as VELCRO) or double-sided adhesive tape may be used. Generally, for this embodiment LEDs 2 are mounted on a thin flexible plastic conduit 6. Enlarged area 7 is provided for holding battery 3 or plug outlet 11 for coupling to generator 3B via electric cord 9. LED display strip 8 therefore typically includes conduit 6, LEDs 2, wiring 10, computer chip 12 and means for connecting to a source of electricity 3.

Figure 2B:
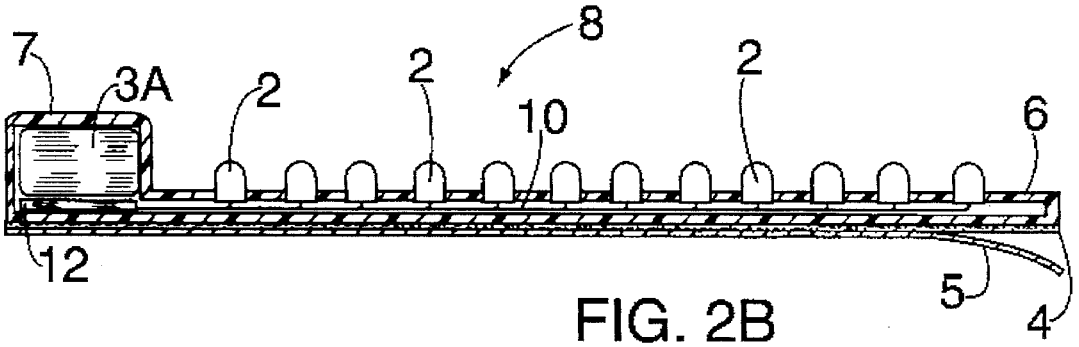
FIG. 2B shows a side view, partially cut away, of the LED display shown in FIG. 2A.

FIG. 2B illustrates adhesive layer 4 shipped together with a release layer 5. An end of release layer 5 is shown being removed to expose the adhesive. Release layer 5 prevents adhesive layer 4 from contacting and adhering to packing materials in shipping.

Figure 3:
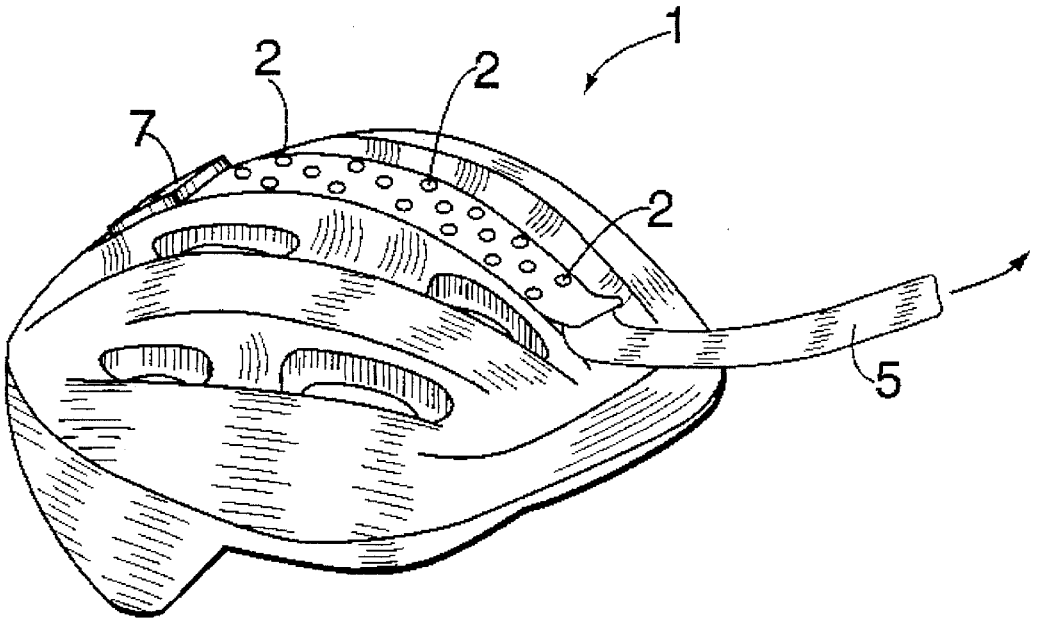
FIG. 3 shows a prospective view of an LED display being applied to a conventional protective helmet.

FIG. 3 shows the LED 2 array being applied to a conventional helmet 1. As shown, release layer 5 is pulled in the direction of the arrow to expose adhesive layer 4. Adhesive layer 4 is then contacted with a surface of helmet 1 so as to adhere thereto and provide the subject helmet. FIG. 3 shows the majority of adhesive layer 4 already in contact with helmet 1.

Upon reading the above description, various alternative embodiments will become obvious to those skilled in the art. These embodiments are to be considered within the scope and spirit of the subject invention, which is only to be limited by the claims which follow and their equivalents.

What is claimed is:

1. A light-emitting-diode display strip affixable to a curved surface of a helmet or the like, the display strip comprising:

(a) an elongated flexible support strip, the flexible support strip being generally conformable to the curved surface;

(b) affixation means for affixing the flexible support strip to the curved surface, the affixation means extending along approximately the entire length of a side of the support strip which defines a backing side of the support strip and being generally conformable to the curved surface for affixing the support strip to the curved surface in a backing-side-to-curved-surface lengthwise-extending, generally curved-surface-conforming relationship;

(c) a plurality of at least three light-emitting diodes mounted at spaced-apart locations along the support strip and visible from a display side of the support strip defined to be opposite to the backing side of the support strip;

(d) LED-lighting timing circuitry mounted on the support strip, the LED-lighting timing circuitry being adapted to provide electrical signals for separately lighting a plurality of at least three light-emitting diodes in a timed sequence;

(e) a power-source connector mounted on the support strip, the power-source connector being connectable to an electric power source; and (f) interconnection wiring extending along the support strip and connected to the light-emitting diodes, the LED-lighting timing circuity, and the power-source connector so that in operation, with an electric power-source connected to the power-source connector, the at least three light-emitting diodes mounted on the support strip are separately lighted in a timed sequence.

2. The light-emitting-diode strip according to claim 1 in which the support strip is made up of a plastic material.

3. The light-emitting-diode display strip according to claim 1 in which the affixation means is a hook-and-loop-type fastener.

4. The light-emitting-diode display strip according to claim 1 in which the affixation means is a layer of adhesive coating on the backing side of the support strip.

5. The light-emitting-diode display strip according to claim 4 comprising an elongated strip of release-layer sheet releasably attached to the adhesive layer on the backing side of the support strip.

6. The light-emitting diode display strip according to claim 1 in which the LED-lighting-timing circuitry comprises a computer chip.

7. The light-emitting-diode display strip according to claim 1 in which the power-source connector is an electric-plug outlet.

8. The light-emitting diode display strip according to claim 1 in which the power-source connector includes an electric battery holder and terminal connector.

* * * * *